US010718058B2

(12) United States Patent
Yi et al.

(10) Patent No.: US 10,718,058 B2
(45) Date of Patent: Jul. 21, 2020

(54) REDUCED IRON PRODUCTION METHOD USING ELECTROWINNING METHOD, AND REDUCED IRON PRODUCED THEREBY

(71) Applicant: SEOUL NATIONAL UNIVERSITY R&DB FOUNDATION, Seoul (KR)

(72) Inventors: Kyung-Woo Yi, Seoul (KR); Jong-Ha Park, Hwaseong-si (KR); Ho-Gil Choi, Seoul (KR)

(73) Assignee: SEOUL NATIONAL UNIVERSITY R&DB FOUNDATION, Seoul (KR)

( * ) Notice: Subject to any disclaimer, the term of this patent is extended or adjusted under 35 U.S.C. 154(b) by 0 days.

(21) Appl. No.: 16/315,960

(22) PCT Filed: May 30, 2017

(86) PCT No.: PCT/KR2017/005641

§ 371 (c)(1),
(2) Date: Jan. 7, 2019

(87) PCT Pub. No.: WO2018/008850

PCT Pub. Date: Jan. 11, 2018

(65) Prior Publication Data

US 2019/0226106 A1 Jul. 25, 2019

(30) Foreign Application Priority Data

Jul. 6, 2016 (KR) ..... 10-2016-0085501

(51) Int. Cl.
*C25C 3/34* (2006.01)
*C25C 7/00* (2006.01)

(52) U.S. Cl.
CPC ..... *C25C 3/34* (2013.01); *C25C 7/005* (2013.01)

(58) Field of Classification Search
CPC ..... C25C 3/34; C25C 7/005
See application file for complete search history.

(56) References Cited

FOREIGN PATENT DOCUMENTS

CN 103180487 A 6/2013
JP 60-211006 10/1985
(Continued)

OTHER PUBLICATIONS

Chinese Office action dated Apr. 8, 2020 for Chinese Patent Application No. 201780042050.8, 6 pages and English machine translation, 6 pages.

*Primary Examiner* — Ciel P Contreras
(74) *Attorney, Agent, or Firm* — Lewis Roca Rothgerber Christie LLP

(57) ABSTRACT

A reduced iron production method using an electrowinning method and reduced iron is provided. The method includes, preparing a mixture by mixing, a solid electrolyte containing sodium peroxide ($Na_2O_2$) and boron oxide ($B_2O_3$), with iron oxide ($Fe_2O_3$); and putting the mixture in an electrowinning device provided with an anode and an insoluble cathode and heating to form a molten oxide and then applying a voltage to the anode and the cathode to form iron on the cathode. Therefore, by reducing iron oxide through an electrowinning method, a reduced iron in a pure iron state can be obtained. Although it is very difficult to obtain pure iron by refining an iron ore, by using the electrowinning method in which the composition of an electrolyte is controlled and electrolysis conditions are controlled, reduced iron that is pure can be obtained.

9 Claims, 9 Drawing Sheets

(56) References Cited

FOREIGN PATENT DOCUMENTS

| | | |
|---|---|---|
| KR | 10-0327848 | 8/2002 |
| KR | 10-2005-0113282 | 12/2005 |
| KR | 10-2010-0116692 | 11/2010 |
| KR | 10-2015-0101457 | 9/2015 |
| KR | 10-1586741 | 1/2016 |

[FIG. 1]
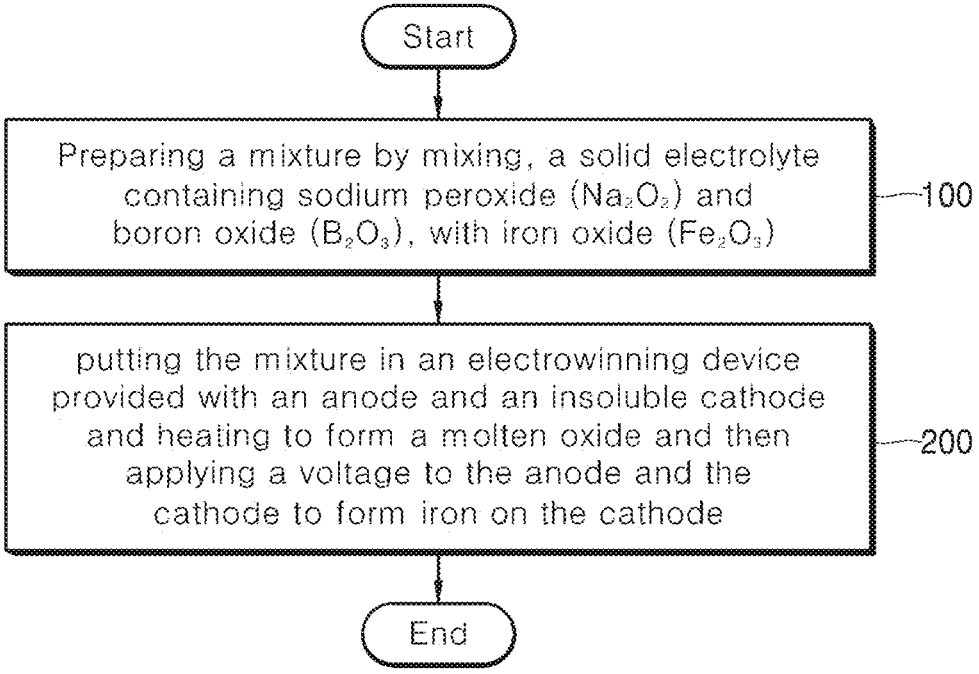

[FIG. 2]
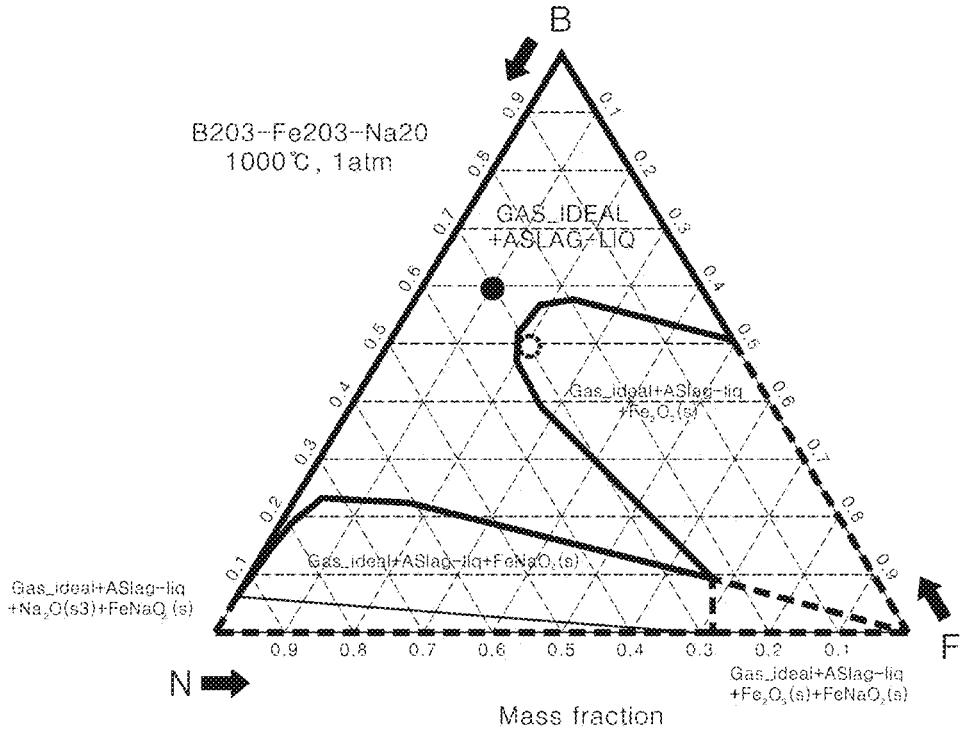

[FIG. 3a]
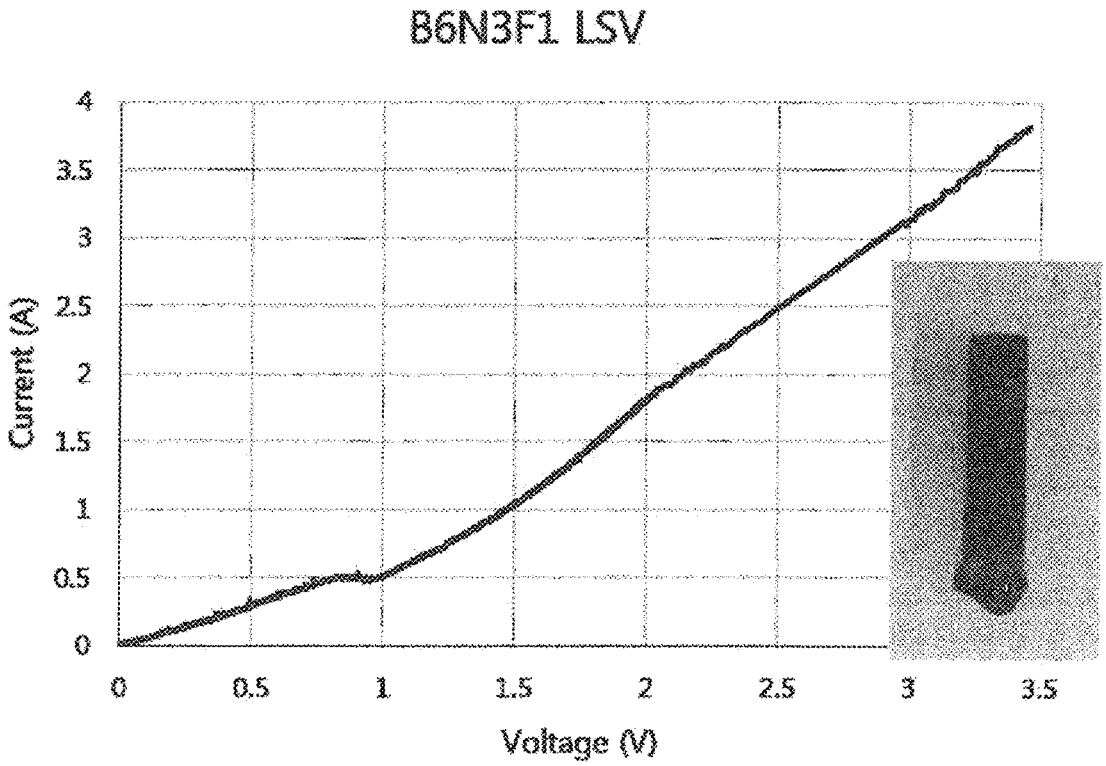

[FIG. 3b]
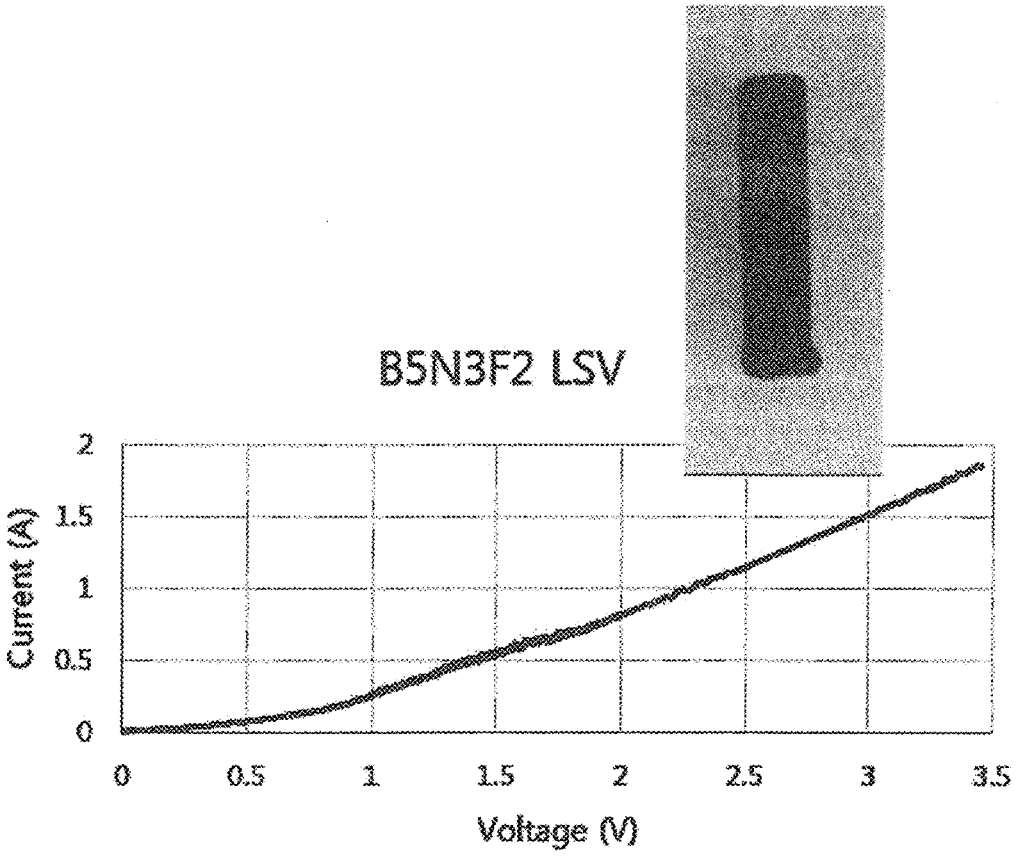

[FIG. 4a]
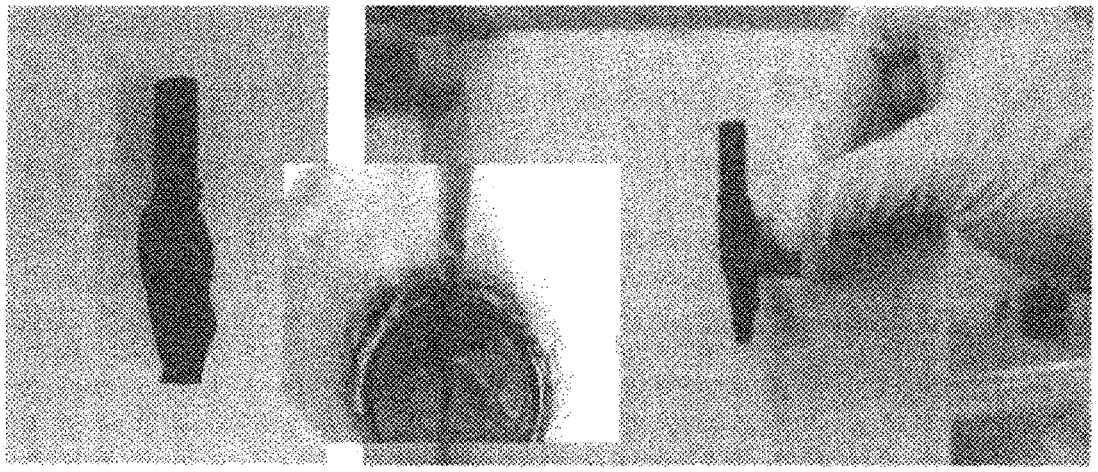

[FIG. 4b]
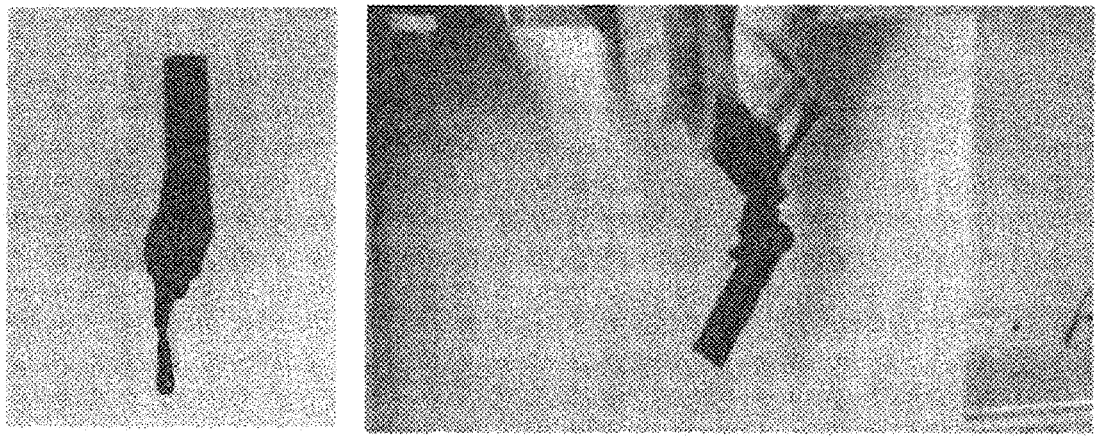

[FIG. 5]
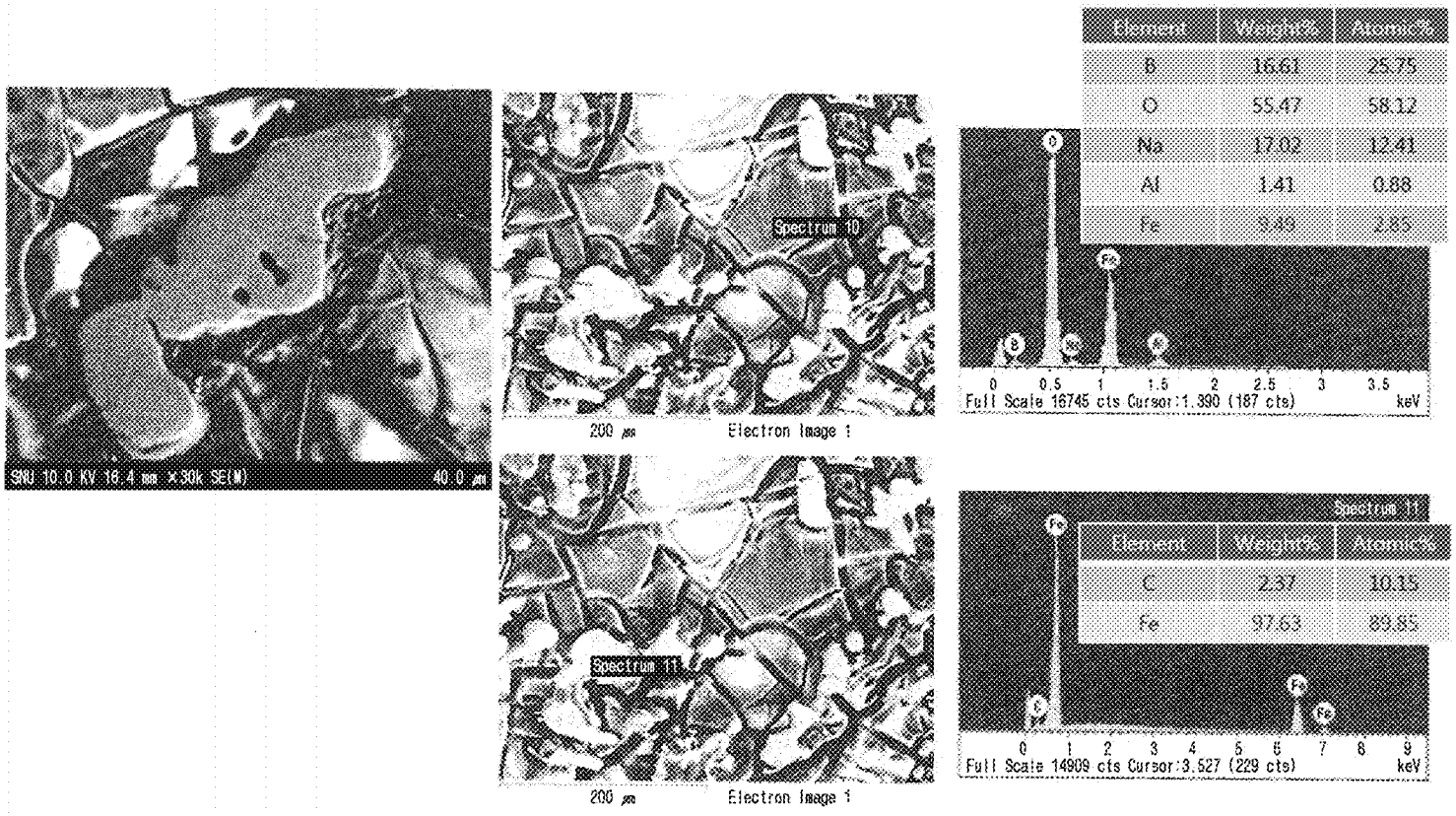

[FIG. 6]
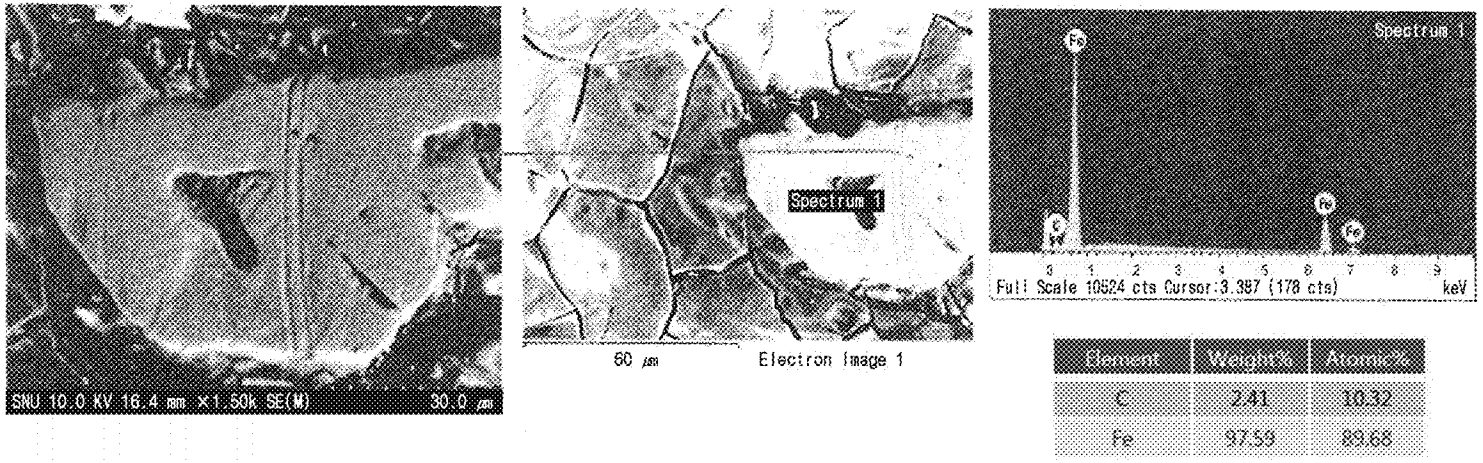

[FIG. 7]
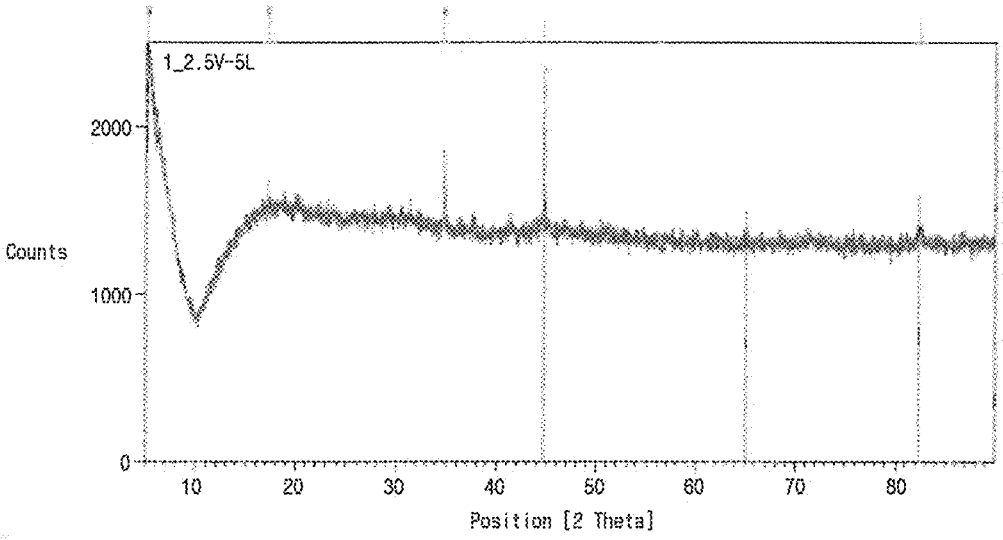
* *Pattern List:* (Bookmark 4)
| Visible | Ref. Code | Score | Compound Name | Displacement [°2Th.] | Scale Factor | Chemical Formula |
|---|---|---|---|---|---|---|
| * | 00-006-0696 | 30 | ferrite | 0.000 | 0.399 | Fe |

REDUCED IRON PRODUCTION METHOD USING ELECTROWINNING METHOD, AND REDUCED IRON PRODUCED THEREBY

CROSS-REFERENCE TO RELATED APPLICATIONS

This application is a U.S. National Phase Patent Application and claims priority to and the benefit of International Application Number PCT/KR2017/005641, Filed May 30, 2017, which claims priority to and benefit of Korean Patent Application No. 10-2016-0085501 filed on Jul. 6, 2016, the entire disclosures of which are incorporated by reference in their entirety.

TECHNICAL FIELD

The present disclosure relates to a reduced iron production method using an electrowinning device and reduced iron produced thereby.

BACKGROUND ART

Iron exists in a large quantity that is second most common in the crust after Aluminum and is mainly cast in steel to be used as a material for various structures, ships, automobiles and various mechanical devices. Iron is not found in the form of pure iron. Starting off from iron hematite, magnetite, calcite, siderite and the like which contain mainly iron, as a raw material, they are roasted to be made into iron oxide. Then, limestone is added as a fusing agent and coke is added as a reducing agent and hot air is blown within a blast furnace, and the coke is burned and at the same time an ore is reduced to be made into iron, and melted to produce pig iron. Meanwhile, to make pure iron from pig iron and a steel scrap, a method of electrolytic refining in an aqueous solution of iron salt with the pig iron and steel scrap as electrodes is used.

As an example of an electrolytic reduction process, there is a method for producing a metal by electrolytic reduction of a feedstock including an oxide of a first metal. The method includes, disposing the feedstock in a state contacting a cathode and a molten salt, disposing an anode within an electrolytic cell in a state contacting the molten salt, and applying a potential between the anode and the cathode to remove oxygen from the feedstock. The anode is a second metal that is a molten metal at an electrolytic temperature in the cell. The second metal is a metal different from the first metal. Oxygen removed from the feedstock upon electrolysis reacts with the molten second metal to form an oxide including the second metal. Therefore, oxygen is not released as a gas at the molten anode (Patent Document 1).

In the method for producing a metal by electrolytic reduction of a feedstock including a metal oxide, iron is obtained from a cathode by using sulfuric acid or hydrochloric acid as an electrolytic solution. Therefore, a problem arises wherein it is difficult to control the purity of the iron due to hydrogen bubbles formed by hydrogen overvoltage during the electrolysis process. Also, there is a problem of increase in costs for the process because the voltage of the electrolytic cell is as very high, as high as 3V, and the power consumption is also high.

Further, as an electrolytic refining method, a metal oxide recovery method includes, preparing a raw material containing titanium and iron, putting the raw material into a refining vessel, putting a molten iron is into the refining vessel, and blowing a gas containing oxygen into the refining vessel. In the process of blowing the gas, the titanium contained in the raw material may be made to be contained in the form of titanium oxide in a slag which is formed when the molten iron is refined (Patent Document 2).

Although the above method discloses a method of recovering valuable metals by electrolytic refining an iron ore containing iron as an iron source, there is a problem that the metal is recovered in an oxide form, so it is difficult to obtain pure iron.

Iron collected by electrolytic refining has very good magnetic properties, and the demand for vacuum tubes and high-performance magnetic materials in addition to catalysts, electromagnetic materials and alloy materials is continuously increasing. Therefore, there still remains a necessity for developing a more efficient method for producing a mass amount of reduced iron using electrolytic refining with a simpler process.

DETAILED DESCRIPTION OF THE DISCLOSURE

Technical Problem

Therefore, the present disclosure uses electrowinning to produce reduced iron by reducing iron oxide more simply and cost-efficiently compared to the conventional reduced iron production methods.

The problems to be solved by the present disclosure are not limited to the above-mentioned problem(s), and another problem(s) not mentioned can be clearly understood by those skilled in the art from the following description.

Technical Solution

The present disclosure is directed to providing a reduced iron production method using an electrowinning method, including, preparing a mixture by mixing, a solid electrolyte containing sodium peroxide ($Na_2O_2$) which is a Group 1 element oxide and boron oxide ($B_2O_3$), with iron oxide ($Fe_2O_3$); and putting the mixture in an electrowinning device provided with an anode and an insoluble cathode and heating to form a molten oxide and then applying a voltage to the anode and the cathode to form iron on the cathode.

Advantageous Effects

According to the present disclosure, by reducing iron oxide through an electrowinning method, a reduced iron in a pure iron state can be obtained. Although it is very difficult to obtain pure iron by refining an iron ore, by using the electrowinning method in which the composition of an electrolyte is controlled and electrolysis conditions are controlled, reduced iron that is pure can be obtained.

Reduced iron can be recovered easily by separating the reducing material using the insoluble cathode. In particular, since the iron oxide can be reduced by using only a solid electrolyte at a low cost, the efficiency is very high and unlike the conventional hydrochloride or sulfate electrolyte, the solid electrolyte can be recovered and used again.

In addition, the reduced iron can be produced in a plate shape rather than a dendrite shape, thereby greatly increasing electrowinning efficiency.

The reduced iron is pure iron, which is close to electrolytic iron, and can be applied to electrode materials and various electric devices.

DESCRIPTION OF THE DRAWINGS

FIG. 1 is a process flow chart showing a process sequence of a reduced iron production method using an electrowinning method according to an embodiment of the present disclosure.

FIG. 2 is a ternary phase diagram ($B_2O_3$—$Na_2O_2$—$Fe_2O_3$) of sodium peroxide ($Na_2O_2$), boron oxide ($B_2O_3$) and iron oxide ($Fe_2O_3$) calculated through the FACTSAGE program.

FIG. 3 is a graph showing a linear sweep voltage-current curve according to the composition of a mixture in a reduced iron production method using an electrowinning method according to an embodiment of the present disclosure.

FIG. 4 is a photograph of a cathode in a voltage difference in a reduced iron production method using an electrowinning method according to an embodiment of the present disclosure.

FIG. 5 is a scanning electron micrograph and energy dispersive spectroscopy of a reduced iron that was subject to electrowinning at a voltage difference of 2.5 V in a reduced iron production method using an electrowinning method according to an embodiment of the present disclosure.

FIG. 6 is a scanning electron micrograph and energy dispersive spectroscopy of a reduced iron that was subject to electrowinning at a voltage difference of 1.5 V in a reduced iron production method using an electrowinning method according to an embodiment of the present disclosure.

FIG. 7 is a graph showing the results of an X-ray diffraction analysis of the reduced iron that was subject to electrowinning according to an embodiment of the present disclosure.

BEST MODE FOR CARRYING OUT THE INVENTION

First, a solid electrolyte was prepared by mixing sodium peroxide ($Na_2O_2$) and boron oxide ($B_2O_3$), which are oxides of Group 1 elements. Iron oxide ($Fe_2O_3$) was mixed with the solid electrolyte, and stirred while being pulverized using a ball mill to prepare a mixture.

A eutectic point was determined through the precomputed ternary phase diagram.

At this time, the mixture contained 60 wt % of boron oxide, 30 wt % of sodium peroxide and 10 wt % of iron oxide.

The mixture was put into an electrowinning device and heated to 1000° C. in a crucible to prepare the mixture as a molten oxide. Then, voltage was adjusted so that the voltage difference of the anode and cathode of the electrowinning device was 1.5 V and 2.5 V and was applied for 3 hours.

As a result of the electrowinning, the material obtained from the cathode was analyzed by X-ray diffraction analysis and scanning electron microscopy (SEM-EDS, e-FlashHR and X-Flash, Bruker Nano GmbH, Germany) equipped with an energy dispersive spectroscopic analyzer.

MODES FOR CARRYING OUT THE INVENTION

Hereinafter, an exemplary embodiment of the present invention will be described in detail.

The advantages and features of the present invention and the manner of accomplishing it will become apparent with reference to the embodiments described in detail below with reference to the accompanying drawings.

The present invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. To fully disclose the scope of the invention to those skilled in the art, and the invention is only defined by the scope of the claims.

Further, in the following description of the present invention, a detailed description of known functions and configurations incorporated herein will be omitted when it may make the subject matter of the present invention rather unclear.

FIG. 1 is a process flow chart showing a process sequence of a reduced iron production method using an electrowinning method according to an embodiment of the present disclosure.

Referring to FIG. 1, the present disclosure provides a reduced iron production method using an electrowinning method, including, preparing a mixture by mixing, a solid electrolyte containing sodium peroxide ($Na_2O_2$) and boron oxide ($B_2O_3$), with iron oxide ($Fe_2O_3$); and putting the mixture in an electrowinning device provided with an anode and an insoluble cathode and heating to form a molten oxide and then applying a voltage to the anode and the cathode to form iron on the cathode.

In the electrowinning method, a metal is extracted using a solvent through a preliminary treatment of an ore that includes metal, the obtained metal-containing solution is purified and electrowinning is performed using an insoluble anode, and low-cost sulfuric acid or hydrochloric acid is used as a solvent, but it is very difficult to control iron purity when the iron ore is extracted and subject to electrowinning.

Therefore, in the case of using an electrowinning method in which the composition and the composition ratio of a solid electrolyte are controlled and the electrolytic conditions are limited, in a reduced iron production method, there is the advantage of easier production than the conventional reduced iron production methods, and it is possible to obtain reduced iron with low costs.

In the electrowinning method using the solid electrolyte, a target metal can be separated using electric energy.

The reduced iron is a pure iron having a very high purity of iron, and is ferromagnetic, and can be used for alloy materials, catalysts, electromagnetic materials and the like.

The sodium peroxide is an oxide of a Group 1 element. Other than the above-mentioned sodium peroxide, one selected from the group consisting of $Na_2O_2$, $Na_2O$, $K_2O_2$, $K_2O$, $Li_2O_2$ and $Li_2$ which are oxides of a Group 1 element can be used. For the boron oxide, $B_2O_3$ can be used.

In the case of selecting the solid electrolyte sodium peroxide and boron oxide, unlike the conventional electrolyte that includes chloride of fluoride, the iron oxide can be melted together with the molten electrolyte. Therefore, it is possible to obtain reduced iron in a single process. The solid electrolyte has no environmental problems due to chlorine or fluorine, and has an advantage that it is not necessary to control the oxygen atmosphere inside the electrolytic furnace.

When reduced iron is produced using an electrowinning method, the anode and the cathode used in the electrowinning can be reused, and a continuous process is possible.

The iron oxide ($Fe_2O_3$) may be prepared by pulverizing hematite.

At this time, the sodium peroxide ($Na_2O_2$), the boron oxide ($B_2O_3$) and the iron oxide ($Fe_2O_3$) can be pulverized and stirred using one selected from the group consisting of a ball mill, an attrition mill, a vibration mill, a jet mill and a wet ultrasonic to prepare the mixture in step S100.

FIG. 2 is a ternary phase diagram of a mixture of sodium peroxide ($Na_2O_2$), boron oxide ($B_2O_3$) and iron oxide ($Fe_2O_3$) according to an embodiment of the present disclosure.

The ternary phase diagram shows phase change depending on the temperature and the element of a material.

Referring to FIG. 2, the composition of the molten oxide can be determined through a precomputed ternary phase diagram.

Here, the ternary phase diagram may be determined at 1000° C. and 1 atm.

The mixing ratio of the mixture may be determined within the region of B:N:F being 6 to 5:3:1 to 2 on the ternary phase diagram ($B_2O_3$—$Na_2O_2$—$Fe_2O_3$) of the oxide of the Group 1 element, boron oxide and iron oxide.

Here, B is boron, N is sodium and F is iron.

Therefore, in one embodiment of the present disclosure, the mixture may include 60 wt % of boron oxide, 30 wt % of sodium peroxide, and 10 wt % of iron oxide.

If the amount of the iron oxide is less than 10% by weight, there is a problem that the yield of the reduced iron is low. If the amount of the iron oxide is more than 20% by weight, there is a problem that the molten oxide does not form in the temperature range of 740 to 1100° C. Further, if the amount of boron oxide in the solid electrolyte that includes the Group 1 element oxide and the boron oxide is less than 50% by weight, there is a problem that the heating temperature exceeds 1100° C. If the amount of boron oxide exceeds 60% by weight, there is a problem that the iron oxide content is lowered and so the yield is lowered.

Meanwhile, when the mixture is filtered through a sieve having a mesh size of 1.0 mm such that the average powder size is homogeneously formed, there is an advantage that the molten oxide can be formed more easily in the step of producing the molten oxide.

When the size of the electrolytic bath is increased, the weight of the mixture may be increased to be higher and a molten oxide can be produced.

In the case of further including pre-sintering the mixture, a mixture of sodium peroxide ($Na_2O_2$), boron oxide ($B_2O_3$) and iron oxide ($Fe_2O_3$) can be smoothly formed into a molten oxide.

The electrowinning device may be provided with an anode and an insoluble cathode. After the mixture is put in and heated to form a molten oxide, a reduced iron may be formed on the cathode by applying a voltage to the anode and the cathode in step S200.

In the case where the mixture is put into an electrowinning device provided with an anode and an insoluble cathode, the device is provided with an electrolytic bath in which a mixture is put in, an anode and an insoluble cathode to which a voltage is applied, and a cation exchange membrane which is an insulator may be further provided between the anode and the insoluble cathode so that iron ions can smoothly move to the insoluble cathode.

The insoluble cathode may be any one selected from the group consisting of carbon, platinum, tantalum and tungsten.

If the insoluble cathode is configured to have elements other than the above-mentioned elements, a problem may occur wherein slime is formed at the cathode due to a reaction between the solid electrolyte and the iron oxide, or the cathode dissolves.

When the heating is performed below the above-mentioned range, a problem may occur wherein the solid electrolyte is not completely melted to form a molten oxide, and so in the following process of electrowinning, the reduction reaction of iron oxide does not occur. When the heating exceeds the above-mentioned range, the energy consumption due to heating is large and so the efficiency of the entire process is very low.

The voltage difference between the anode and the cathode of the electrowinning device may be 1.5 V to 2.5 V.

The reduction reaction of iron can be maintained within the range of the above-mentioned voltage difference, and the reduction reaction does not occur if the difference is less than the voltage difference range.

Even in the case where the voltage difference is 2.5 V or more, the reduction reaction is maintained in the electrowinning process, so the voltage difference is not limited to 2.5 V. It is preferable to have a voltage of 2.5 V or lower since it is possible to recover an amount of reduced iron efficiently relative to the power consumed.

In addition, at 1.5 V or higher, the reduction reaction is maintained and reduced iron is formed, but when it exceeds 2.5 V, the reduced iron is formed into a dendrite shape instead of a plate shape thereby the amount of solid electrolyte impurities in the reduced iron increases and high purity reduced iron cannot be produced.

Voltages can be applied to the anode and the cathode for 3 hours.

The application time of the voltage may be changed depending on the capacity of the crucible.

According to another aspect of the present disclosure, there is provided a reduced iron produced through an electrowinning method, produced by preparing a mixture by mixing, a solid electrolyte containing sodium peroxide ($Na_2O_2$) and boron oxide ($B_2O_3$), with iron oxide ($Fe_2O_3$), and putting the mixture in an electrowinning device provided with an anode and an insoluble cathode and heating to form a molten oxide and then applying a voltage to the anode and the cathode to form reduced iron on the cathode.

Here, the reduced iron is formed on the surface of the cathode and may be formed in a plate shape.

When the metal oxide is reduced by a conventional electrolytic sampling method, a dendrite form appears on the surface of the cathode, thereby reducing electrowinning efficiency and the problem of impregnation of impurities may occur. However, the above-mentioned reduced iron is formed in a plate form of a cathode, so there is an advantage in that the efficiency is increased and the purity of the reduced iron is very high.

The reduced iron may be formed of a black bottom portion having irregular cracks and a white protruding portion protruding from the bottom portion.

The white protruding portion may be configured to have pure iron having high purity, containing 97.63 wt % of iron. Therefore, in the case where the composition ratio and the voltage condition of an electrowinning step are controlled by mixing iron oxide with a solid electrolyte, it is possible to easily obtain high purity reduced iron through the electrowinning method.

Hereinafter, the present disclosure will be described in more detail with reference to the following examples. However, the scope of the present disclosure is not limited to the following examples.

<Example 1> Producing Reduced Iron Using Electrowinning

First, a solid electrolyte was prepared by mixing sodium peroxide ($Na_2O_2$) and boron oxide ($B_2O_3$), which are oxides of Group 1 elements. Iron oxide ($Fe_2O_3$) was mixed with the solid electrolyte and stirred while being pulverized using a ball mill to prepare a mixture.

A eutectic point was determined through a precomputed ternary phase diagram.

At this time, the mixture contained 60 wt % of boron oxide, 30 wt % of sodium peroxide and 10 wt % of iron oxide.

The mixture was put into an electrowinning device and heated to 1000° C. in a crucible to prepare the mixture as a molten oxide. Then, voltage was adjusted so that the voltage difference of the anode and cathode of the electrowinning device was 1.5 V and 2.5 V and was applied for 3 hours.

As a result of the electrowinning, the material obtained from the cathode was analyzed by X-ray diffraction analysis and scanning electron microscopy (SEM-EDS, e-FlashHR and X-Flash, Bruker Nano GmbH, Germany) equipped with an energy dispersive spectroscopic analyzer.

<Experimental Example 1> Confirmation of Reduction Reaction

We investigated the feasibility of reducing iron oxide ($Fe_2O_3$) during an electrowinning process, the iron oxide being relatively easy to reduce in a solid electrolyte including sodium peroxide ($Na_2O_2$) and boron oxide ($B_2O_3$).

First, the state diagram of the ternary system was calculated at 1000° C. and 1 atm using the FACTSAGE program.

FIG. 2 is a ternary phase diagram ($B_2O_3$—$Na_2O_2$—$Fe_2O_3$) of sodium peroxide ($Na_2O_2$), boron oxide ($B_2O_3$) and iron oxide ($Fe_2O_3$) calculated through the FACTSAGE program.

Referring to FIG. 2, within a process region, a composition of B:N:F being 6:3:1 is indicated by a red dot expressed as B6N3F1, and a composition of B:N:F being 5:3:2 is indicated by a black dot expressed as B6N3F2.

When heated at 1000° C. for 1 hour in order to confirm the eutectic points for the two compositions, it was confirmed that both of the two compositions melted and it was confirmed that it was possible to form a molten oxide with the mixture of Experimental Example 1.

Meanwhile, the B6N3F1 and B6N3F2 were analyzed by linear sweep voltammetry (LSV) in order to confirm the reduction reaction during the electrowinning process of iron oxide ($Fe_2O_3$).

FIG. 3 is a graph showing a linear sweep voltage-current curve according to the composition of a mixture in a reduced iron production method using an electrowinning method according to an embodiment of the present disclosure.

Referring to FIG. 3A, a change point is shown where the graph is bends and then rises due to the reduction reaction in the 1 V region of the B6N3F1 composition.

The picture of FIG. 3A is a photograph of the cathode, and it was confirmed that a black substance having a viscosity was adhered to the surface of the cathode and so it was confirmed that the mixture was melted.

Referring to FIG. 3B, it was found that the slope of the B6N3F2 composition rises slightly at 0.8 V and vibrates slightly at 1.5 V, but it was determined that it was not a reaction point.

Therefore, it was confirmed that the reduction reaction occurred very well in the composition of B6N3F1, and then a constant voltage test was performed on the composition of B6N3F1.

<Experimental Example 2> Constant Voltage Test

A constant voltage test was conducted on B6N3F1 of Experimental Example 1 in order to confirm whether the reduction reaction of the cathode was maintained and the iron was continuously reduced according to the voltage difference.

The voltage was applied at 1.5 V and 2.5 V, respectively, and electrolyzed for 3 hours.

FIG. 4 is a photograph of a cathode according to voltage difference in a reduce iron production method using an electrowinning method according to an embodiment of the present disclosure.

FIG. 4A is a photograph of the cathode when a voltage of 2.5 V is applied, and FIG. 4B is a photograph of the cathode when a voltage of 1.5 V is applied.

Referring to FIG. 4, it was confirmed that a large amount of reduced material was produced at the cathode.

It was confirmed that a larger amount was adsorbed when a voltage of 2.5 V was applied than when a voltage of 1.5 V was applied.

When the adsorbed material was separated from the cathode and the magnets were brought close to each other, it was confirmed that all of them adhered to the magnets. Thus the material reduced at the cathode was confirmed to be ferromagnetic.

TABLE 1

| Voltage application condition | | Weight before experiment | Weight after experiment |
|---|---|---|---|
| 2.5 V-3 hrs | Crucible | 1030.9 g | |
| | Crucible + sample | 1327.7 g | 1302.7 g |
| 1.5 V-3 hrs | Crucible | 1081.0 g | |
| | Crucible + sample | 1376.3 g | 1348.8 g |

Table 1 shows changes in the weight of the crucible and the sample after electrowinning.

As shown in Table 1, the weight of the crucible and the sample decreased from 1376.3 g to 1348.8 g at 1.5 V, and the weight of the crucible and the sample decreased from 1327.4 g to 1302.7 g at 2.5 V. The amount of the adsorbed material was smaller at 1.5 V than at 2.5 V so the change in weight of the sample after the experiment was smaller. Therefore, it was confirmed that the reduction reaction proceeded efficiently when a voltage of 2.5 V was applied.

<Experimental Example 3> Analysis of Reduced Iron Components

FIG. 5 is a scanning electron micrograph and energy dispersive spectroscopy of a reduced iron that was subject to electrowinning at a voltage difference of 2.5 V in a reduced iron production method using an electrowinning method according to an embodiment of the present disclosure.

Referring to FIG. 5, a scanning electron micrograph of the material separated from the cathode at the left side is shown, and the reduced material has a white plate shaped protruding part.

Therefore, it was confirmed that the material separated from the cathode was formed as a black shell form with crack thereon with a distinguishable white-colored protruding portion having a plate shape.

Particularly in the analysis of the energy dispersive spectroscopy, in the portion where the cracks were formed, it was confirmed that it contained boron (16.61 wt %), oxygen (55.47 wt %), sodium (17.02 wt %), aluminum (1.41 wt %) and iron (9.49 wt %). It was confirmed that the electrolyte and iron components were mixed in the crack portion (spectrum 10).

On the other hand, it was confirmed that only the reduced iron composition (spectrum 11, Fe 97.63 wt %) was present in the white protruding portion, and it was confirmed that the reduced iron that is pure iron having high purity can be formed by the electrowinning method.

Meanwhile, it was confirmed that the reduction reaction proceeded even at a voltage of 1.5 V to form reduced iron.

FIG. 6 is a scanning electron micrograph and energy dispersive spectroscopy of a reduced iron that was subject to electrowinning at a voltage difference of 1.5 V in a reduced iron production method using an electrowinning method according to an embodiment of the present disclosure.

Referring to FIG. 6, it can be seen that a reduced iron composition exists even at a voltage difference of 1.5 V, and that the dark shell portion has an electrolytic composition and a pure iron composition is formed at the white protruding portion.

<Experimental Example 4> Property Analysis

In order to confirm the exact composition of reduced iron, an X-ray diffraction analysis experiment was performed on the material separated from the cathode.

In a total of four experiments, first and second experiments were performed at a voltage difference of 2.5 V. The third and fourth experiments were performed at a voltage difference of 1.5 V.

FIG. 7 is a graph showing the results of an X-ray diffraction analysis of the reduced iron that was subject to electrowinning according to an embodiment of the present disclosure.

Referring to FIG. 7, it was confirmed that 100% ferrite peaks were present in all four experiments, and it was confirmed that iron was reduced using the electrowinning method.

Accordingly, in the reduced iron production method using an electrowinning method according to the present disclosure, a molten oxide is prepared by pre-confirming the eutectic point of a composition of a solid electrolyte to be fed to an electrolytic device according to a ternary phase diagram which is a thermal-phonetic analysis method. At a voltage difference, of 1.5 V and 2.5 V, electrowinning is performed and reduced iron can be obtained.

It was confirmed that the reduced iron was pure iron having a very high purity of iron, ferromagnetic, and formed in a plate shape, so that the electrolysis efficiency was extremely high.

Although a specific embodiment of the reduced iron production method using an electrowinning method according to the present disclosure has been described so far, it is apparent that various modifications can be made without departing from the scope of the present disclosure.

Therefore, the scope of the present disclosure should not be limited to the embodiments described, but should be determined by the equivalents of the claims, as well as the following claims.

That is, it is to be understood that the foregoing embodiments are illustrative and not restrictive in all respects and that the scope of the present disclosure is indicated by the appended claims rather than the foregoing description, and all changes or modifications derived from the equivalents thereof should be construed as being included within the scope of the present invention.

The invention claimed is:

1. A reduced iron production method using an electrowinning method, comprising, preparing a mixture by mixing, a solid electrolyte containing sodium peroxide ($Na_2O_2$) and boron oxide ($B_2O_3$), with iron oxide ($Fe_2O_3$); and putting the mixture in an electrowinning device provided with an anode and an insoluble cathode and heating to form a molten oxide and then applying a voltage to the anode and the cathode to form iron on the cathode.

2. The method of claim 1, wherein a mixing ratio of the mixture is determined within the region of B:N:F (here, B is boron, N is sodium and F is iron) being 6 to 5:3:1 to on a ternary phase diagram ($B_2O_3$—$Na_2O_2$—$Fe_2O_3$) of sodium peroxide ($Na_2O_2$), boron oxide ($B_2O_3$) and iron oxide ($Fe_2O_3$).

3. The method of claim 1, wherein a mixing ratio of the mixture contains 60 wt % of boron oxide, 30 wt % of sodium peroxide, and 10 wt % of iron oxide.

4. The method of claim 2, wherein the ternary phase diagram is determined at 1000° C. and 1 atm.

5. The method of claim 1, wherein the insoluble cathode is any one selected from the group consisting of carbon, platinum, tantalum and tungsten.

6. The method of claim 1, wherein the heating is performed at a temperature range of 740 to 1100° C.

7. The method of claim 1, wherein a voltage difference between the anode and the cathode ranges from 1.5 V to 2.5 V.

8. The method of claim 1, wherein the voltage is applied to the anode and the cathode for 3 hours.

9. The method of claim 1, wherein iron is reduced at the cathode and is formed in a plate shape.

* * * * *